US012442157B2

(12) United States Patent
Ma et al.

(10) Patent No.: US 12,442,157 B2
(45) Date of Patent: Oct. 14, 2025

(54) ROTARY FRAME AND GRADE

(71) Applicant: Jiangsu XCMG Construction Machinery Research Institute Ltd., Jiangsu (CN)

(72) Inventors: Hongfeng Ma, Jiangsu (CN); Penglong Hou, Jiangsu (CN); Le Gao, Jiangsu (CN)

(73) Assignee: Jiangsu XCMG Construction Machinery Research Institute Ltd., Jiangsu (CN)

( * ) Notice: Subject to any disclaimer, the term of this patent is extended or adjusted under 35 U.S.C. 154(b) by 834 days.

(21) Appl. No.: 17/717,660

(22) Filed: Apr. 11, 2022

(65) Prior Publication Data

US 2023/0235528 A1 Jul. 27, 2023

(30) Foreign Application Priority Data

Jan. 27, 2022 (CN) ..... 202210099244.4

(51) Int. Cl.
*E02F 3/80* (2006.01)
*E02F 3/76* (2006.01)
*E02F 3/84* (2006.01)

(52) U.S. Cl.
CPC ..... *E02F 3/80* (2013.01); *E02F 3/764* (2013.01); *E02F 3/7645* (2013.01); *E02F 3/7659* (2013.01); *E02F 3/844* (2013.01)

(58) Field of Classification Search
CPC . E02F 3/80; E02F 3/764; E02F 3/7645; E02F 3/7659; E02F 3/844
USPC ..... 172/781, 792, 793
See application file for complete search history.

(56) References Cited

U.S. PATENT DOCUMENTS

2011/0247845 A1* 10/2011 Greuel ..... A01B 31/00 172/765
2014/0338933 A1* 11/2014 Harris ..... E02F 3/7645 172/1

FOREIGN PATENT DOCUMENTS

| | | | | |
|---|---|---|---|---|
| CA | 1279989 C | | 2/1991 | |
| CN | 106351278 A | | 1/2017 | |
| CN | 110894729 A | * | 3/2020 | ..... A01B 35/02 |
| CN | 111305294 A | | 6/2020 | |

(Continued)

OTHER PUBLICATIONS

Chinese Office Action issued on Nov. 3, 2022 for CN Application No. 202210099244.4 (14 pages including English Translation).

*Primary Examiner* — Christopher J Sebesta
*Assistant Examiner* — Evan A Bregel
(74) *Attorney, Agent, or Firm* — Merchant & Gould P.C.

(57) ABSTRACT

The present disclosure discloses a rotary frame and a grader, and relates to the field of a grader. The rotary frame includes: a rotary ring, provided with a recessed portion and an opening; a first connecting piece fixed at the periphery of the rotary ring, one end of the first connecting piece being attached to the periphery of the rotary ring and the other end of the first connecting piece being separated from the periphery of the rotary ring; a second connecting piece, the second connecting piece being also fixed at the periphery of the rotary ring, and one end of the second connecting piece being attached to the periphery of the rotary ring and the other end of the second connecting piece being separated from the periphery of the rotary ring; a supporting base fixed on an inner wall of the rotary ring and located in the recessed portion.

16 Claims, 6 Drawing Sheets

(56) References Cited

FOREIGN PATENT DOCUMENTS

| | | | | | |
|---|---|---|---|---|---|
| CN | 212052927 | U | * | 12/2020 | ..... E02F 3/76 |
| DE | 102019203763 | A1 | * | 10/2019 | ..... E02F 3/7636 |

* cited by examiner

ROTARY FRAME AND GRADE

CROSS-REFERENCE TO RELATED APPLICATIONS

The present application is based on and claims the priority of Chinese patent application No. 202210099244.4 filed on Jan. 27, 2022, the disclosure of which is incorporated herein by reference in its entirety.

FIELD OF THE INVENTION

The present disclosure relates to the field of a grader, and in particular, to a rotary frame and a grader.

DESCRIPTION OF RELATED ART

The grader is a main machine for shaping and leveling operations in earthwork engineering, and is also an important in national defense construction, mine construction, road construction, water conservancy construction, farmland improvement and the like. The reason why the grader has an extensive auxiliary operation ability has a great relation with the fact that the blade rotates 360 degrees and the soil shoveling angle of the blade is adjusted in real time according to the operation environment. The rotary frame of the grader serves as a main bearing structure for realizing the function, and the life of the rotary frame directly determines the service life of the whole vehicle. In recent years, with the continuous improvement of the operation performance of the grader and the increasing tonnage, the length and the load of the blade are correspondingly increased, and the rotary frame has insufficient bending strength, is liable to damage and affects the service life of the whole vehicle.

In the prior art, a rotary ring of the rotary frame of the grader is round. In order to enhance the structural strength of the rotary frame, a triangular reinforcing plate is arranged in a triangular area between the rotary ring and a connecting plate to form a local reinforcing structure.

The inventors have found that there are at least the following problems in the prior art. The rotary frame structure is unreasonable, the arrangement of the rib plate leads to the phenomena that the weight of the rotary frame structure and the number of weld joints are increased, the welding process has high difficulty and the welding stress is concentrated, resulting in frequent failure of the rotary frame.

SUMMARY OF THE INVENTION

The present disclosure provides a rotary frame and a grader, for improving the bearing capacity of a rotary frame on the premise of realizing a lightweight construction of the rotary frame.

The embodiments of the present disclosure provide a rotary frame, including:

a rotary ring, provided with a recessed portion and an opening, the opening is in the circumferential direction of the rotary ring, the rotary ring being configured to be symmetrical with respect to its own center line, and the center line passing through the rotary center of the rotary ring and the center of the opening;

a first connecting piece, fixed at the periphery of the rotary ring, one end of the first connecting piece being attached to the periphery of the rotary ring and the other end of the first connecting piece being separated from the periphery of the rotary ring;

a second connecting piece, the second connecting piece and the first connecting piece being arranged symmetrically with respect to the center line, the second connecting piece being also fixed at the periphery of the rotary ring, and one end of the second connecting piece being attached to the periphery of the rotary ring and the other end of the second connecting piece being separated from the periphery of the rotary ring; and a supporting base, fixed on an inner wall of the rotary ring and located in the recessed portion.

In some embodiments, the rotary ring includes:

an arc-shaped section, configured to be arc-shaped;

a first flat plate section, fixed at one end of the arc-shaped section;

a second flat plate section, fixed at the other end of the arc-shaped section;

a first protruded section, fixed on an end part of the first flat plate section away from the arc-shaped section, the end part of the first protruded section away from the first flat plate section being a first protruded end, and the first protruded end being protruded away from the rotary center of the rotary ring; and a second protruded section, fixed on an end part of the second flat plate section away from the arc-shaped section, the end part of the second protruded section away from the second flat plate section being a second protruded end, and the second protruded end being protruded away from the rotary center of the rotary ring, wherein the first protruded end is separated from the second protruded end to form the opening of the rotary ring; and the arc-shaped section, the first flat plate section, the second flat plate section, the first protruded section and the second protruded section jointly form the recessed portion in a surrounding way.

In some embodiments, a length of the first protruded end along an axis direction of the rotary frame is greater than a length of the first flat plate section along the axis direction of the rotary frame; and/or a length of the second protruded end along the axis direction of the rotary frame is greater than a length of the second flat plate section along the axis direction of the rotary frame.

In some embodiments, the arc-shaped section, the first flat plate section, the second flat plate section, the first protruded section and the second protruded section are configured to be integrated.

In some embodiments, a connection part of the first flat plate section and the first protruded section is configured to be protruded towards the axis direction of the rotary ring; and/or a connection part of the second flat plate section and the second protruded section is configured to be protruded towards the axis direction of the rotary ring.

In some embodiments, a first inserting groove is formed on an end part of the first protruded section away from the first flat plate section, a second inserting groove is formed on an end part of the second protruded section away from the second flat plate section, and the supporting base is inserted in the first inserting groove and the second inserting groove.

In some embodiments, the supporting base is configured as a flat plate, one part of an edge of the supporting base is attached to an inner wall of the recessed portion, the remaining edge of the supporting base is configured as a boss protruded away from the rotary center of the rotary frame, and the boss stretches out of the recessed portion through the first inserting groove, the second inserting groove and the opening of the rotary ring.

In some embodiments, a first groove is formed on an end part of the first protruded section away from the first flat plate section; the rotary frame further includes a first connection portion; the first connection portion is fixedly connected to the first protruded section; the first connection portion is provided with a second groove; the first groove and the second groove are pieced to form a first fixing hole for mounting an oil cylinder; and/or a third groove is formed on an end part of the second protruded section away from the second flat plate section; the rotary frame further includes a second connection portion; the second connection portion is fixedly connected to the second protruded section; the second connection portion is provided with a fourth groove; and the third groove and the fourth groove are pieced to form a second fixing hole for mounting the oil cylinder.

In some embodiments, the first connecting piece includes:

a first section, attached and fixed to an outer surface of the arc-shaped section;

a second section, attached and fixed to an outer surface of the first flat plate section, and also fixedly connected to the first section; and a third section, located on one side of the second section away from the first section, the third section being protruded out of the rotary ring along the axial direction of the rotary ring and being also fixedly connected to the second section.

In some embodiments, the third section is provided with a first pin hole.

In some embodiments, the arc-shaped section, the first section, the second section and the third section are configured to be integrated.

In some embodiments, the second connecting piece includes:

a fourth section, attached and fixed to an outer surface of the arc-shaped section;

a fifth section, attached and fixed to an outer surface of the second flat plate section, and also fixedly connected to the fourth section; and a sixth section, located on one side of the fifth section away from the fourth section, the sixth section being protruded out of the rotary ring along the axial direction of the rotary ring and being also fixedly connected to the fifth section.

In some embodiments, the sixth section is provided with a second pin hole.

In some embodiments, the supporting base is provided with a through hole, and a loop of connecting holes are formed in the circumferential direction of the through hole.

In some embodiments, the rotary frame is symmetrical relative to the center line.

The embodiments of the present disclosure further provide a grader, including the rotary frame provided by any technical solution of the present disclosure.

In some embodiments, the grader further includes:

an angle position device, rotatably mounted at the first pin hole of the first connecting piece and the second pin hole of the second connecting piece;

a blade, slidingly mounted on the angle position device; and an oil cylinder, mounted between the rotary ring and the angle position device.

In some embodiments, the grader further includes:

a driving part, in driving connection with the blade to drive the blade to slide relative to the angle position device; and a guide part, including a sliding groove and a guide rail, wherein the angle position device is provided with the sliding groove, the blade is fixedly connected to the guide rail, and the sliding groove cooperates with the guide rail.

The rotary frame provided by the above technical solution changes the structure of the rotary frame, so that the rotary frame includes a plurality of layers starting from the circle center of the rotary ring, wherein the innermost layer is the supporting base, the second layer is the rotary ring, and the third layer is the first connecting piece and the second connecting piece. The above technical solution starts from the design source, reduces, even avoids the phenomenon of stress concentration caused by uncoordinated local stiffness of the rotary frame, and improves the fatigue resistance of the structure, so that the mechanical analysis result of the rotary frame is better; furthermore, the material utilization rate and the lightweight level are high, the number of weld joints is small, and the process welding difficult is easy; in addition, the conflicting demand of the structural strength and the lightweight of the rotary frame is well balanced, and the rotary frame has a light structure and high fatigue resistance.

BRIEF DESCRIPTION OF THE DRAWINGS

The accompanying drawings described here are provided for further understanding of the present disclosure, and constitute a part of the application. The exemplary embodiments and description thereof of the present disclosure are intended to explain the present disclosure, but do not constitute inappropriate limitations to the present disclosure. In the accompanying drawings.

REFERENCE NUMERALS

Figure 1:
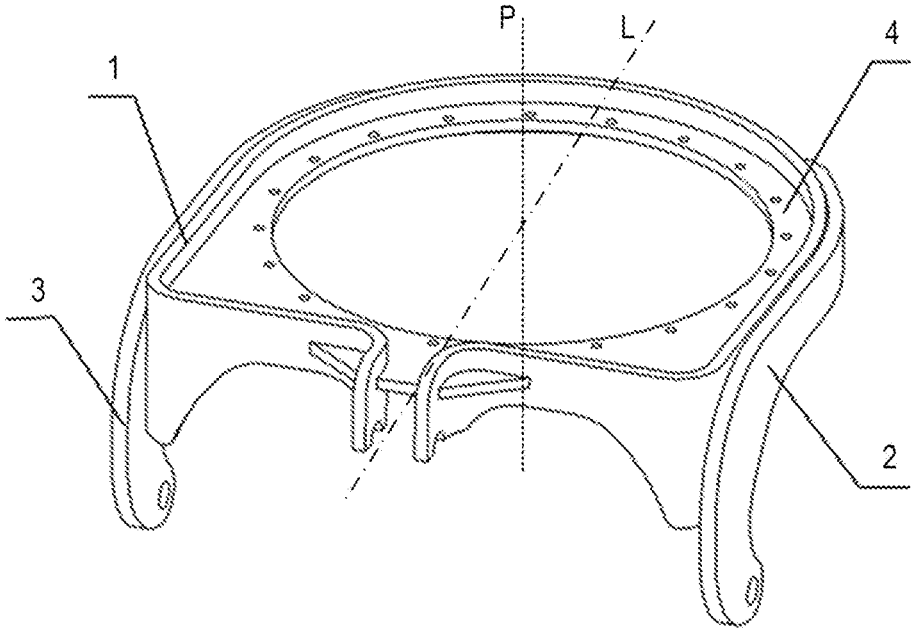
FIG. 1 is a schematic diagram of a three-dimensional structure of a rotary frame according to some embodiments of the present disclosure.

1. Rotary ring; 2. First connecting piece; 3. Second connecting piece; 4. Supporting base; 5. Angle position device; 6. Blade; 7. Oil cylinder; 8. Driving part; 9. Guide part; 10. First connection portion; 17. Second connection portion.

11. Recessed portion; 12. Arc-shaped section; 13. First flat plate section; 14. Second flat plate section; 15. First protruded section; 16. Second protruded section.

151. First protruded end; 152. First inserting groove; 153. First groove; 161. Second protruded end; 162. Second inserting groove; 163. Third groove.

101. Second groove; 171. Fourth groove; a. First fixing hole; b. Second fixing hole.

21. First section; 22. Second section; 23. Third section.

31. Fourth section; 32. Fifth section; 33. Sixth section.

231. First pin hole; 331. Second pin hole.

41. Boss; 42. Through hole; 43. Connecting hole.

51. First end plate; 52. Second end plate; 53. Cylinder body; 54. First connecting base; 55. Second connecting base.

81. Cylinder barrel; 82. Rod body.

91. Sliding groove; 92. Guide rail.

DESCRIPTION OF THE INVENTION

The technical solution provided by the present disclosure is described below in detail with reference to FIG. 1 to FIG. 13.

The inventors found that in the prior art, the structural form of the rotary frame is roughly sickle-shaped and the structural strength of the rotary frame is enhanced; and in related art, a triangular reinforcing plate is arranged in a triangular area between the rotary ring and a connecting plate to form a local reinforcing structure. The rotary frame structure is unreasonable, and the arrangement of the rib plate brings various disadvantages that the weight of the rotary frame structure and the number of weld joints are increased, the welding process has high difficulty, and the welding quality is not good. In particular, the intersection point of three weld joints formed by the triangular reinforcing plate, the rotary ring and the connecting plate is located at the high-stress area of the whole structure. Since the stress concentration often occurs at the weld joint, resulting in frequent structural failure in this area. So, the inventors provides a rotary frame and a grader as follows.

The embodiments of the present disclosure provide a rotary frame, including: a rotary ring 1, a first connecting piece 2, a second connecting piece 3 and a supporting base 4. The rotary frame 1 is provided with a recessed portion 11 and an opening 18, the recessed portion 11 is configured to be open in its own circumferential direction, an opening 18 is in the circumferential direction of the rotary frame 1. The rotary ring 1 is configured to be symmetrical with respect to its own center line, and the center line passes through the rotary center of the rotary ring 1 and the center of the opening. The first connecting piece 2 is fixed at the periphery of the rotary ring 1; and one end of the first connecting piece 2 is attached to the periphery of the rotary ring 1 and the other end of the first connecting piece 2 is separated from the periphery of the rotary ring 1. The second connecting piece 3 and the first connecting piece 2 are arranged symmetrically with respect to the center line. The second connecting piece 3 is also fixed at the periphery of the rotary ring 1; and one end of the second connecting piece 3 is attached to the periphery of the rotary ring 1 and the other end of the second connecting piece 3 is separated from the periphery of the rotary ring 1. The supporting base 4 is fixed on an inner wall of the rotary ring 1 and located in the recessed portion 11.

Referring to FIG. 1 to FIG. 4, the rotary ring 1 is three-dimensional, a first end face (that is, upper end faces shown in FIG. 1 and FIG. 3) of the rotary ring 1 along an axial direction is flat, and a second end face (that is, lower end faces shown in FIG. 1 and FIG. 3) of the rotary ring 1 along the axial direction is not flat. The first end face is used to be connected to a traction frame of the rotary frame. The first end face is set to be planar, so that the rotary frame can be connected to the traction frame conveniently. The second end face is set to be non-planar, so that a reinforcing part is arranged on one side where the second end face of the rotary frame is located, thereby improving the structural strength of the rotary frame, and greatly improving the bearing capacity of the rotary frame and the use reliability on the premise of realizing lightweight.

Referring to FIG. 1 to FIG. 4, in some embodiments, the rotary ring 1 is integrally formed by a plurality of flat plates; and in some other embodiments, the rotary ring 1 is integrally formed by an arc-shaped plate and a flat plate. The integrally forming manners include casting, extruding, bending and the like.

The rotary ring 1 is fixed to the first connecting piece 2 and the second connecting piece 3 in a welding manner, a riveting manner or through a bolt and other connecting pieces. A peripheral surface of the supporting base 4 is attached to an inner wall of the recessed portion 11, so that the contact area of the rotary ring 1 and the recessed portion 11 is effectively enlarged, the bearing of the rotary ring 1 is more stable, and the stress is more balanced.

Figure 2:
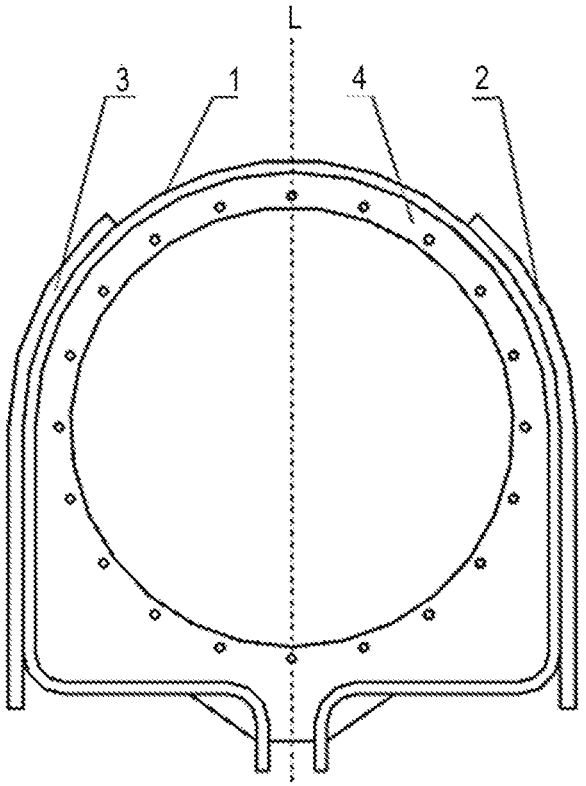
FIG. 2 is a schematic diagram of a front view of a rotary frame according to some embodiments of the present disclosure.

Referring to FIG. 1 to FIG. 4, the rotary frame is a symmetrical structure. Specifically, the rotary frame is symmetrical with respect to its own center line. FIG. 1 and FIG. 2 show the position of the center line, and the center line L refers to a straight line connecting the rotary center of the rotary frame and the center of the opening. Similarly, the rotary frame is also symmetrical with respect with a central axis surface passing through the center line and the central axis P of the rotary frame. Therefore, the rotary ring 1 itself is also symmetrical with respect to the center line. The first connecting piece 2 and the second connecting piece 3 are also symmetrical with respect to the center line. The supporting base 4 itself is also symmetrical with respect to the center line. The specific implementation manners of each part are described below in detail.

Figure 3:
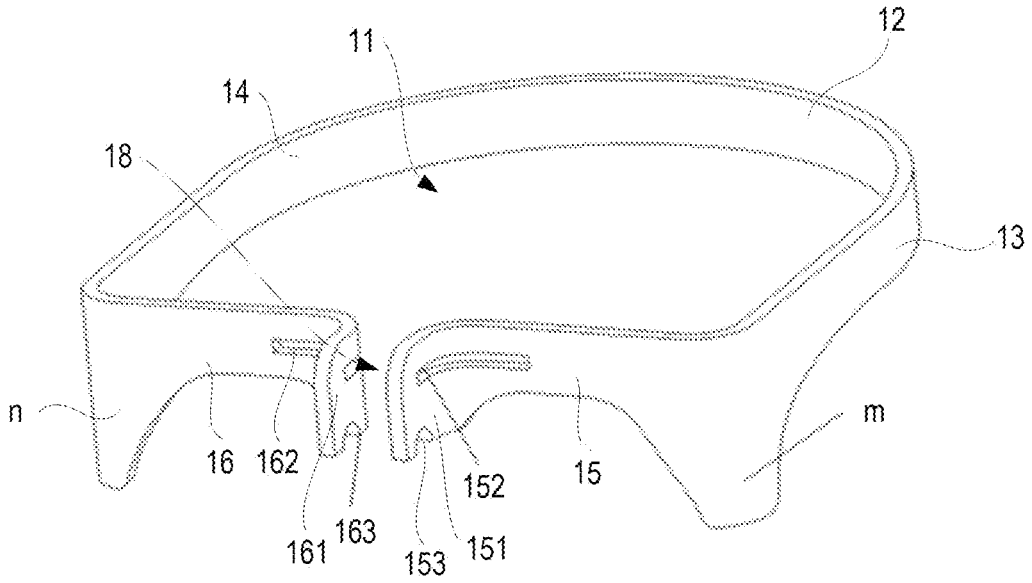
FIG. 3 is a schematic diagram of a three-dimensional view of a rotary ring of a rotary frame according to some embodiments of the present disclosure.
Figure 4:
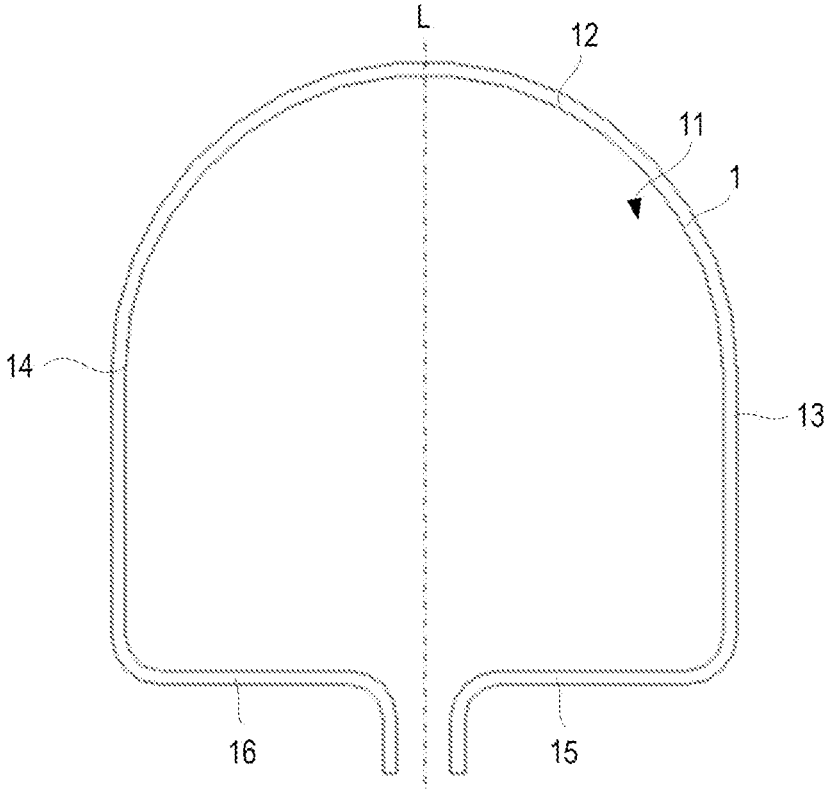
FIG. 4 is a schematic diagram of a front view of a rotary ring of a rotary frame according to some embodiments of the present disclosure.

Referring to FIG. 3 and FIG. 4, in some embodiments, the rotary ring 1 includes an arc-shaped section 12, a first flat plate section 13, a second flat plate section 14, a first protruded section 15 and a second protruded section 16. The arc-shaped section 12 is configured to be arc-shaped. The first flat plate section 13 is fixed at one end of the arc-shaped section 12. The second flat plate section 14 is fixed at the other end of the arc-shaped section 12. The first protruded section 15 is fixed on an end part of the first flat plate section 13 away from the arc-shaped section 12, an end part of the first protruded section 15 away from the first flat plate section 13 is a first protruded end 151, and the first protruded end 151 is protruded away from the rotary center of the rotary ring 1. The second protruded section 16 is fixed on an end part of the second flat plate 14 away from the arc-shaped section 12, an end part of the second protruded section 16 away from the second flat plate section 14 is a second protruded end 161, and the second protruded end 161 is protruded away from the rotary center of the rotary ring 1. The first protruded end 151 and the second protruded end 161 are separated to from the opening of the rotary ring 1. The arc-shaped section 12, the first flat plate section 13, the second flat plate section 14, the first protruded section 15 and the second protruded section 16 jointly form the recessed portion 11 in a surrounding way.

The arc-shaped section 12 is, for example, a semicircular arc-shaped plate. Each part of the arc-shaped section 12 has the same wall thickness along an arc length direction. Each part of the arc-shaped section 12 also has the same size in an axis direction P of the rotary frame.

The structures of the first flat plate section 13 and the second flat plate section 14 are symmetrical with respect to the center line. Both the first flat plate section 13 and the second flat plate section 14 are flat plates without bending. Inner walls and outer walls of the first flat plate section 13 and the second flat plate section 14 are all planar. Both the first flat plate section 13 and the second flat plate section 14, and the arc-shaped section 12 are integrated. One side facing towards the rotary center of the rotary frame is the inside, and one side away from the rotary center of the rotary frame is the outside.

The first protruded section 15 and the second protruded section 16 are special-shaped structures, and the first protruded section 15 and the second protruded section 16 are symmetrical with respect to the center line. Both the first protruded section 15 and the second protruded section 16 are protruded towards a direction away from the rotary center of the rotary frame relative to the arc-shaped section 12. FIG. 3 and FIG. 4 clearly illustrate the protruded directions of the first protruded section 15 and the second protruded section 16. Both the first protruded section 15 and the second protruded section 16 are bending structures, and the first protruded section 15 and the second protruded section 16 are each integrated.

A length of the first protruded end 151 of the first protruded section 15 along the axis direction of the rotary frame is greater than a length of the other part of the first protruded section 15 along the axis direction of the rotary frame, so that a non-planar structure is formed on the second end face at the position of the first protruded end 151, and it is beneficial to enhance the structural strength of the rotary frame.

The first protruded end 151 and the other part of the first protruded section 15 are in smooth transition, so that the stress concentration is reduced, and the bearing capacity of the rotary frame is better. The second protruded end 161 and the other part of the second protruded section 16 are in smooth transition, so that the stress concentration is reduced, and the bearing capacity of the rotary frame is improved.

A length of the second protruded end 161 of the second protruded section 16 along the axis direction of the rotary frame is greater than a length of the other part of the second protruded section 16 along the axis direction of the rotary frame, so that a non-planar structure is formed on the second end face at the position of the second protruded end 161, and it is beneficial to enhance the structural strength of the rotary frame.

Referring to FIG. 3 and FIG. 4, in some embodiments, the arc-shaped section 12, the first flat plate section 13, the second flat plate section 14, the first protruded section 15 and the second protruded section 16 are configured to be integrated. By adoption of the structure, the structure of the whole rotary frame is a stable whole body with high bearing capacity. Furthermore, the rotary ring 1 itself does not have a weld joint and the whole structure is three-dimensional; furthermore, the first end face is planar, the second end face is uneven, and the rotary frame has high structural strength and high bearing capacity; moreover, the rotary frame includes a small number of parts, the whole structure is very light, and the structure of the rotary frame is more stable and reliable on the premise of realizing the lightweight.

Referring to FIG. 3 and FIG. 4, in some embodiments, a connection part m of the first flat plate section 13 and the first protruded section 15 is configured to be protruded along the axis direction of the rotary ring 1. And/or a connection part n of the second flat plate section 14 and the second protruded section 16 is configured to be protruded along the axis direction of the rotary ring 1.

Continuously referring to FIG. 3 and FIG. 4, in some embodiments, a first groove 153 is formed on an end part of the first protruded section 15 away from the first flat plate section 13; the rotary frame further includes a second connection portion 10; the first connection portion 10 is fixedly connected to the first protruded section 15; and the first connection portion 10 is provided with a second groove 101. The first groove 153 and the second groove 101 are pieced to form a first fixing hole a to mount an oil cylinder 7.

The first groove 153 and the second groove 101 are two separated parts. During mounting, the oil cylinder 7 is placed at a required mounting position, and then the first protruded section 15 and the first connection portion 10 are fixed. Specifically, the first protruded section 15 and the first connection portion 10 are fixedly connected through a bolt.

In some embodiments, a third groove 163 is formed on an end part of the second protruded section 16 away from the second flat plate section 14. The rotary frame further includes a second connection portion 17; and the second connection portion 17 and the second protruded section 16 are fixedly connected. The second connection portion 17 is provided with a fourth groove 171. The third groove 163 and the fourth groove 171 are pieced to form a second fixing hole b to mount an oil cylinder 7. The oil cylinder 7 is specifically fixed jointly through the first fixing hole a and the second fixing hole b.

The third groove 163 and the fourth groove 171 are two separated parts. During mounting, the oil cylinder 7 is placed at a required mounting position, and then the second protruded section 16 and the second connection portion 17 are fixed. Specifically, the second protruded section 16 and the second connection portion 17 are fixedly connected through a bolt.

Referring to FIG. 3 and FIG. 4, in some embodiments, a first inserting groove 152 is formed on an end part of the first protruded section 15 away from the first flat plate section 13. A second inserting groove 162 is formed on an end part of the second protruded section 16 away from the second flat plate section 14, and the supporting base 4 is inserted in the first inserting groove 152 and the second inserting groove 162. The first inserting groove 152 and the second inserting groove 162 are symmetrical with respect to the center line and the central axis surface. The length directions of the first inserting groove 152 and the second inserting groove 162 are both perpendicular to the axis direction of the rotary frame. One part of the first inserting groove 152 is located at the first protruded end 151, and one part of the second inserting groove 162 is located at the second protruded end 161.

The first inserting groove 152 and the second inserting groove 162 both play a role in positioning the supporting base 4. The supporting base 4 is welded with the first inserting groove 152 and the second inserting groove 162, so that the mounting and fixing reliability of the first protruded section 15, the second protruded section 16 and the supporting base 4 is improved, and the relative position of the supporting base 4 and the rotary ring 1 is positioned reliably.

Figure 5:
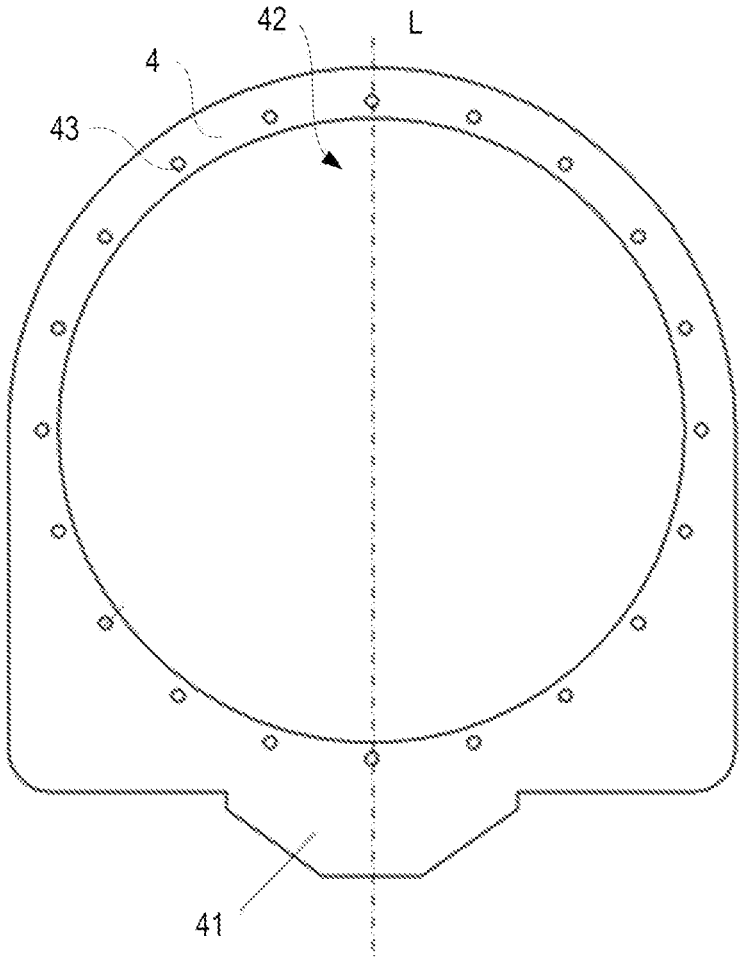
FIG. 5 is a schematic diagram of a front view of a supporting base of a rotary frame according to some embodiments of the present disclosure.

Referring to FIG. 1, FIG. 2 and FIG. 5, in some embodiments, the supporting base 4 is configured to be a flat plate, one part of an edge of the supporting base 4 is attached to an inner wall of the recessed portion 11, the remaining edge of the supporting base 4 is configured to be a boss 41 protruded away from the rotary center of the rotary frame, and the boss 41 stretches out of the recessed portion 11 through the first inserting groove 152, the second inserting groove 162 and the rotary ring 1. The supporting base 4 is a flat plate and has high processing and manufacturing efficiency; furthermore, the supporting base 4 is provided with a boss 41 cooperating with the first inserting groove 152, the second inserting groove 162 and the rotary ring 1, so that the supporting base 4 and the rotary ring 1 are fixed in a welding manner; moreover, the boss 41 also forms inserting connection with the first inserting groove 152 and the second inserting groove 162, so that the rotary ring 1 and the supporting base 4 can be positioned accurately, the rotary ring 1 and the supporting base 4 are fixed in an inserting connection manner, and the connection manner is more reliable.

Referring to FIG. 1, FIG. 2 and FIG. 5, in some embodiments, the supporting base 4 is provided with a through hole 42, and a loop of connecting holes 43 are formed in the circumferential direction of the through hole 42. A slewing bearing is connected to the rotary frame through the connecting holes 43, the slewing bearing is also connected to a traction frame, and the slewing of the traction frame relative to the rotary frame is realized through the slewing bearing.

Figure 6:
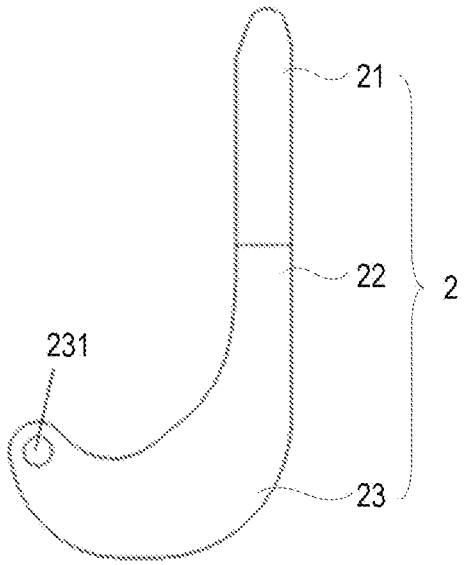
FIG. 6 is a schematic diagram of a front view of a first connecting piece of a rotary frame according to some embodiments of the present disclosure.
Figure 7:
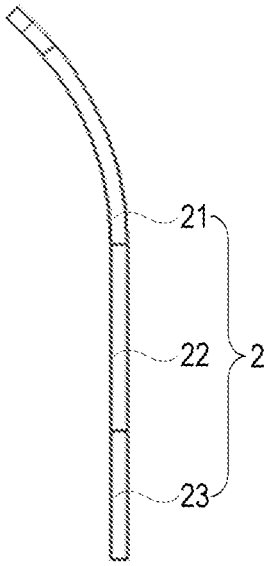
FIG. 7 is a schematic diagram of a side view of a first connecting piece of a rotary frame according to some embodiments of the present disclosure.

Referring to FIG. 1, FIG. 6 and FIG. 7, in some embodiments, the first connecting piece 2 includes a first section 21, a second section 22 and a third section 23. The first section 21 is attached and fixed to the arc-shaped section 12. The second section 22 is attached and fixed to the first flat plate section 13. The third section 23 is protruded out of the rotary ring 1 along the axial direction of the rotary ring 1. The wall thickness of the first connecting piece 2 is uniform. The first connecting piece 2 adopts a bending plate piece, so on one hand, the contact area between the first connecting piece 2 and the rotary ring 1 is large and the connection between the first connecting piece 2 and the rotary ring 1 is more reliable, and on the other hand, processing and manufacturing are facilitated.

Referring to FIG. 1, FIG. 6 and FIG. 7, in some embodiments, the third section 23 is provided with a first pin hole 231. The function of the first pin hole 231 will be described below with reference to other structures of the grader.

Figure 8:
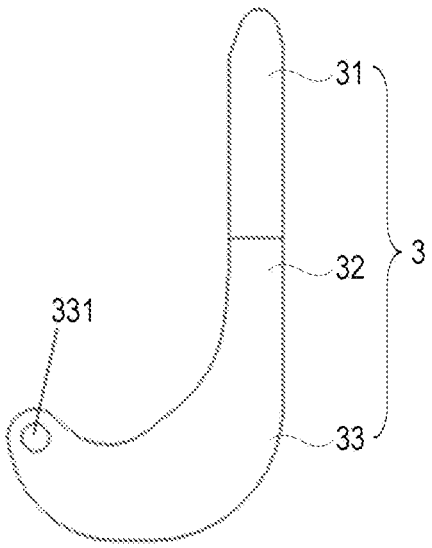
FIG. 8 is a schematic diagram of a front view of a second connecting piece of a rotary frame according to some embodiments of the present disclosure.
Figure 9:
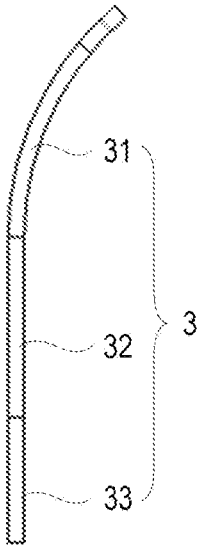
FIG. 9 is a schematic diagram of a side view of a second connecting piece of a rotary frame according to some embodiments of the present disclosure.

Referring to FIG. 1, FIG. 8 and FIG. 9, in some embodiments, the second connecting piece 3 includes a fourth section 31, a fifth section 32 and a sixth section 33. The fourth section 31 is attached and fixed to the arc-shaped section 12; the fifth section 32 is attached and fixed to the second flat plate section 14; and the sixth section 33 is protruded out of the rotary ring 1 along the axial direction of the rotary ring 1.

Referring to FIG. 1, FIG. 8 and FIG. 9, in some embodiments, the sixth section 33 is provided with a second pin hole 331. The function of the second pin hole 331 will be described below with reference to other structures of the grader.

Referring to FIG. 10 TO FIG. 13, the embodiments of the present disclosure further provide a grader, including the rotary frame provided by any technical solution of the present disclosure.

Figure 10:
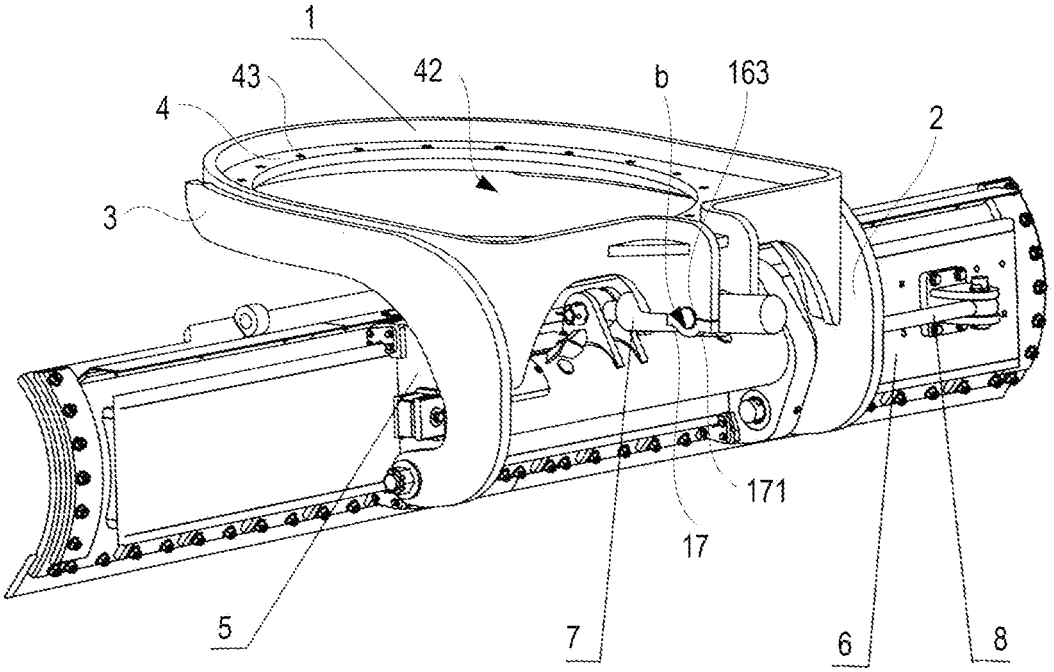
FIG. 10 is a first schematic diagram of a using state of a rotary frame according to some embodiments of the present disclosure.
Figure 11:
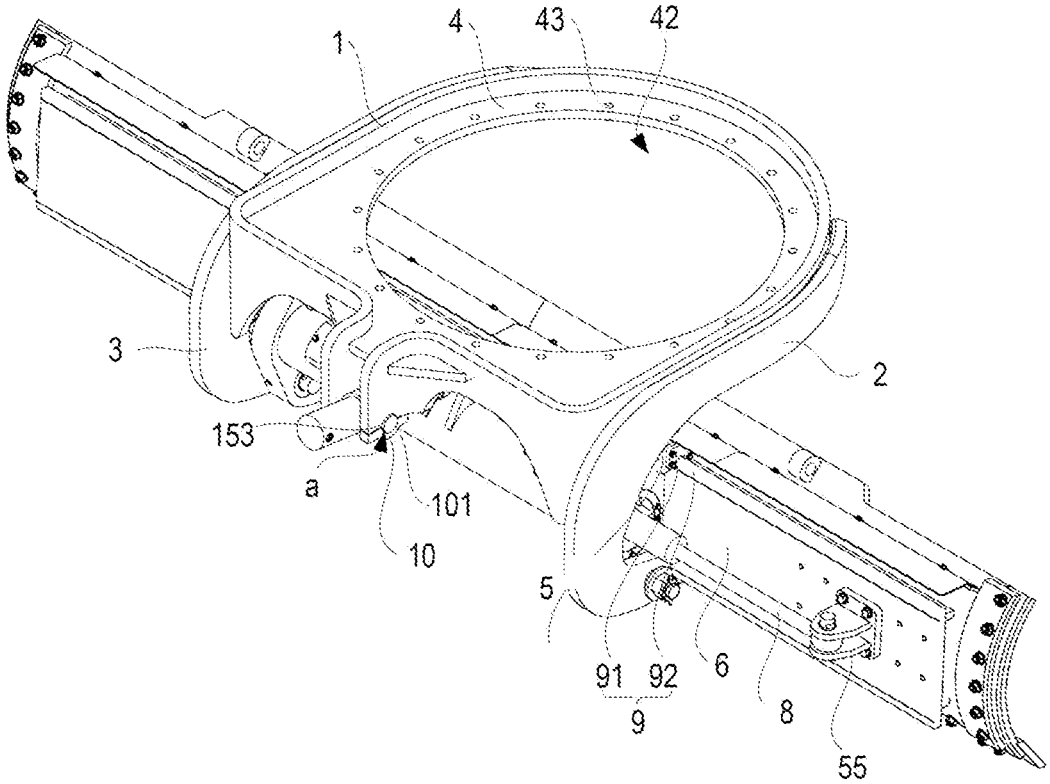
FIG. 11 is a second schematic diagram of a using state of a rotary frame according to some embodiments of the present disclosure.
Figure 12:
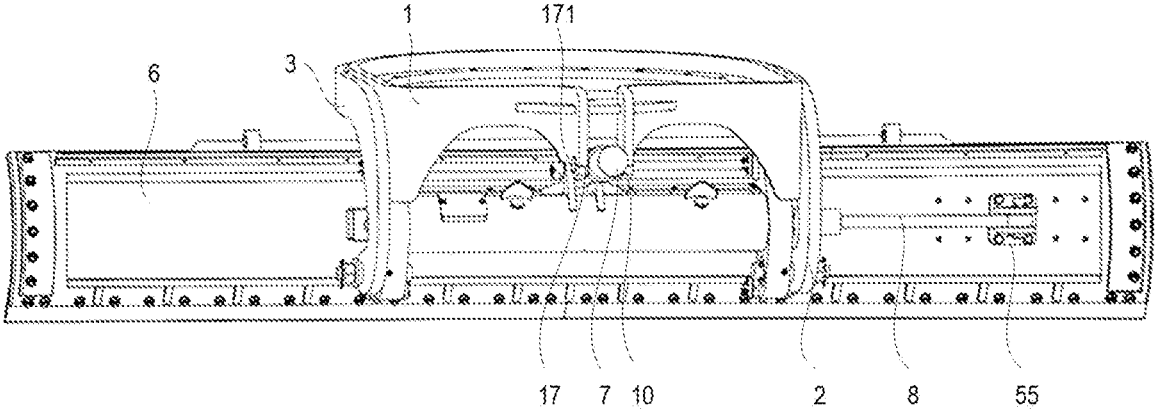
FIG. 12 is a third schematic diagram of a using state of a rotary frame according to some embodiments of the present disclosure.

Referring to FIG. 10, in some embodiments, the grader further includes an angle position device 5, a blade 6 and an oil cylinder 7. The angle position device 5 is rotatably mounted at the first pin hole 231 of the first connecting piece 2 and the second pin hole 331 of the second connecting piece 3. The blade 6 is slidingly mounted on the angle position device 5. The oil cylinder 7 is mounted between the rotary ring 1 and the angle position device 5. The oil cylinder 7 drives the angle position device 5 and the blade 6 to rotate relative to the rotary frame.

Figure 13:
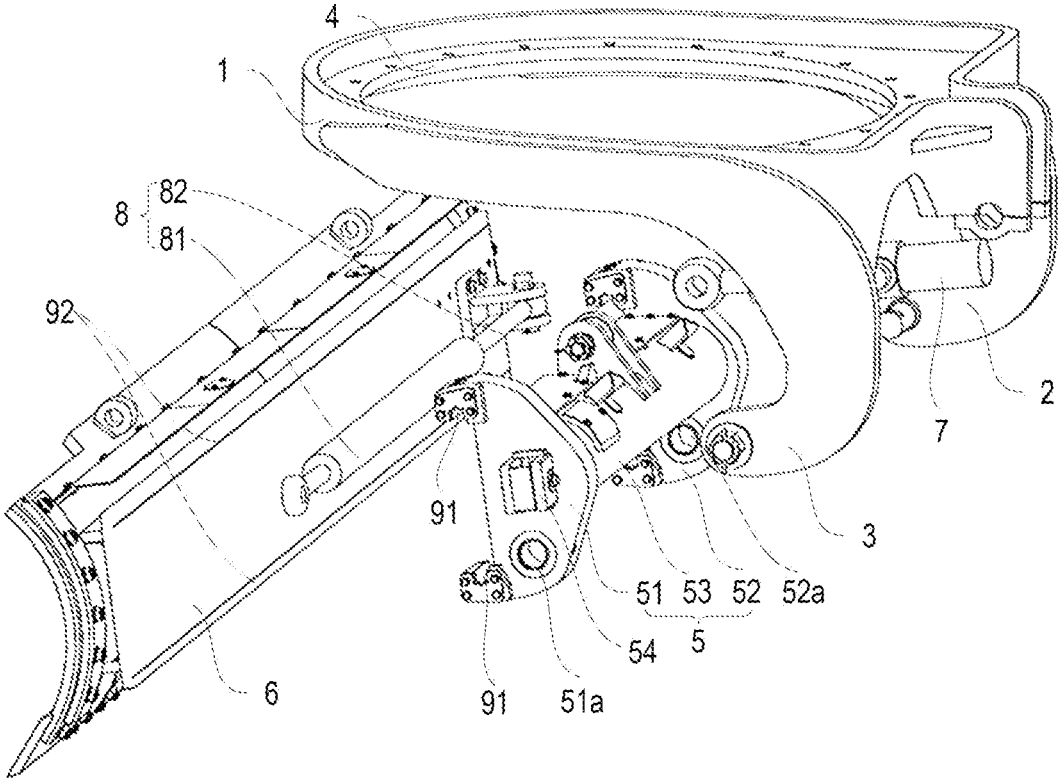
FIG. 13 is a schematic exploded view of a rotary frame according to some embodiments of the present disclosure.

Referring to FIG. 13, the angle position device 5 includes a first end plate 51, a second end plate 52 and a cylinder body 53. One end of the cylinder body 53 is fixed to the first end plate 51, and the other end of the cylinder body 53 is fixed to the second end plate 52. The first end plate 51 is provided with a first mounting hole 51*a*, and the second end plate 52 is provided with a second mounting hole 52*a*. A shaft passes through the first mounting hole 51*a*, the second pin hole 331, the first pin hole 231 and the second mounting hole 52*a*, so that the angle position device 5 is rotatably connected to the rotary frame.

Referring to FIG. 10 to FIG. 13, in some embodiments, the grader further includes a driving part 8 and a guide part 9. The driving part 8 is in driving connection with the blade 6 so as to drive the blade 6 to slide relative to the angle position device 5. The guide part 9 includes a sliding groove 91 and a guide rail 92. The angle position device 5 is provided with the sliding groove 91, the blade 6 is fixedly connected to the guide rail 92, and the sliding groove 91 cooperates with the guide rail 92.

Referring to FIG. 13, the angle position device 5 further includes a first connecting base 54. The first connecting base 54 is fixed on the first end plate 51 of the angle position device. The driving part 8 is a telescopic cylinder, and the telescopic cylinder is sleeved in the cylinder body 53. The telescopic cylinder includes a cylinder barrel 81 and a rod body 82, and the rod body 82 is slidingly mounted on the cylinder barrel 81. One end of the cylinder barrel 81 away from the rod body 82 is fixedly connected to the first connecting base 54. Referring to FIG. 13, the first end plate 51 is fixed to the connecting base 54, and the cylinder barrel 81 is fixedly connected to the connecting base 54 through a bolt. One end of the rod body 82 away from the cylinder barrel 81 is connected to the blade 6. Specifically, the blade 6 is fixedly connected to a second connecting base 55, and the rod body 82 is fixedly connected to the second connecting base 55 through a bolt. Linear sliding motion of the blade 6 is driven by the driving part 8.

Multiple groups of guide parts 9 are provided. In some embodiments, four sliding grooves 91 are provided, two of the sliding grooves 91 are arranged at the top end and the bottom end of the first end plate 51 correspondingly; and the other two sliding grooves 91 are arranged at the top end and the bottom end of the second end plate 52 correspondingly. Two groups of guide rails 92 are provided. The two groups of guide rails 92 of the guide parts 9 are parallel with each other, and the mounting heights of the two guide rails 92 are different. The two guide rails 92 are staggered, one of the guide rails 92 corresponds to the sliding groove 91 at the top end of the first end plate 51 and the sliding groove 91 at the top end of the second end plate 52, and the other one of the guide rails 92 corresponds to the sliding groove 91 at the bottom end of the first end plate 51 and the sliding groove 91 at the bottom end of the second end plate 52. By this arrangement manner, the linear motion of the blade 6 is more stable.

In the description of the present disclosure, it should be understood that an azimuth or position relationship indicated by terms "center", "longitudinal", "transverse", "front", "rear", "left", "right", "vertical", "horizontal", "top", "bottom", "inner", "outer" and the like is an azimuth or position relationship based on the accompanying draws, which is only for facilitating description of the present disclosure and simplifying description, but not indicates or implies that the referred device or component must have a specific azimuth and perform construction and operation in the specific azimuth; therefore, it cannot be interpreted as a limitation to the protection scope of the present disclosure.

Finally, it should be noted that the above embodiments are only used to describe the technical solution of the present disclosure, but not to limit to it. Although the present disclosure is described in detail with reference to the foregoing embodiments, those of ordinary skill in the art should understand: the technical solution recorded by each embodiment still can be modified, or part of the technical features can be replaced equivalently, but these modifications or replacements do not make the essence of the corresponding technical solution depart from the spirit and scope of the technical solution of each embodiment of the present disclosure.

The invention claimed is:

1. A rotary frame, comprising:

a rotary ring, provided with a recessed portion and an opening communicated with each other, the opening is in U circumferential direction of the rotary ring; the rotary ring being configured to be symmetrical with respect to its own center line, and the center line passing through the rotary center of the rotary ring and the center of the opening;

a first connecting piece, fixed at the periphery of the rotary ring, one end of the first connecting piece being attached to the periphery of the rotary ring and the other end of the first connecting piece being separated from the periphery of the rotary ring;

a second connecting piece, the second connecting piece and the first connecting piece being arranged symmetrically with respect to the center line, the second connecting piece being also fixed at the periphery of the rotary ring, and one end of the second connecting piece being attached to the periphery of the rotary ring and the other end of the second connecting piece being separated from the periphery of the rotary ring; and a supporting base, fixed on an inner wall of the rotary ring and located in the recessed portion;

wherein the rotary ring comprises:

an arc-shaped section, configured to be arc-shaped;

a first flat plate section, fixed at one end of the arc-shaped section;

a second flat plate section, fixed at the other end of the arc-shaped section;

a first protruded section, fixed on an end part of the first flat plate section away from the arc-shaped section, the end part of the first protruded section away from the first flat plate section being a first protruded end, and the first protruded end being protruded away from the rotary center of the rotary ring; and a second protruded section, fixed on an end part of the second flat plate section away from the arc-shaped section, the end part of the second protruded section away from the second flat plate section being a second protruded end, and the second protruded end being protruded away from the rotary center of the rotary ring, wherein the first protruded end is separated from the second protruded end to form the opening of the rotary ring; and the arc-shaped section, the first flat plate section, the second flat plate section, the first protruded section and the second protruded section jointly form the recessed portion in a surrounding way;

wherein a first inserting groove is formed on an end part of the first protruded section away from the first flat plate section, a second inserting groove is formed on an end part of the second protruded section away from the second flat plate section, and the supporting base is inserted in the first inserting groove and the second inserting groove.

2. The rotary frame according to claim 1, wherein the rotary ring defines a central axis extending in an axis direction and substantially surrounded by the arc-shaped section, the first and second flat plate sections and the first and second protruded sections, and wherein a length of the first protruded end along the axis direction of the rotary frame is greater than a length of the first flat plate section along the axis direction of the rotary frame; and/or a length of the second protruded end along the axis direction of the rotary frame is greater than a length of the second flat plate section along the axis direction of the rotary frame.

3. The rotary frame according to claim 1, wherein the arc-shaped section, the first flat plate section, the second flat plate section, the first protruded section and the second protruded section are integrated.

4. The rotary frame according to claim 1, wherein the rotary ring defines a central axis extending in an axis direction and substantially surrounded by the arc-shaped section, the first and second flat plate sections and the first and second protruded sections, and wherein a connection part of the first flat plate section and the first protruded section is protruded towards the axis direction; and/or a connection part of the second flat plate section and the second protruded section is protruded towards the axis direction of the rotary ring.

5. The rotary frame according to claim 1, wherein the supporting base is configured as a flat plate, one part of an edge of the supporting base is attached to an inner wall of the recessed portion, the remaining edge of the supporting base is configured as a boss protruded away from the rotary center of the rotary frame, and the boss stretches out of the recessed portion through the first inserting groove, the second inserting groove and the opening of the rotary ring.

6. The rotary frame according to claim 1, wherein a first groove is formed on an end part of the first protruded section away from the first flat plate section; the rotary frame further comprises a first connection portion; the first connection portion is fixedly connected to the first protruded section; the first connection portion is provided with a second groove; the first groove and the second groove are pieced to form a first fixing hole (a) for mounting an oil cylinder; and/or a third groove is formed on an end part of the second protruded section away from the second flat plate section; the rotary frame further comprises a second connection portion; the second connection portion is fixedly connected to the second protruded section; the second connection portion is provided with a fourth groove; and the third groove and the fourth groove are pieced to form a second fixing hole (b) for mounting the oil cylinder.

7. The rotary frame according to claim 1, wherein the first connecting piece comprises:

a first section, attached and fixed to an outer surface of the arc-shaped section;

a second section, attached and fixed to an outer surface of the first flat plate section, and also fixedly connected to the first section; and a third section, located on one side of the second section away from the first section, the third section being protruded out of the rotary ring along the axial direction of the rotary ring and being also fixedly connected to the second section.

8. The rotary frame according to claim 7, wherein the third section is provided with a first pin hole.

9. The rotary frame according to claim 7, wherein the first section, the second section and the third section are integrated.

10. The rotary frame according to claim 1, wherein the second connecting piece comprises:

a fourth section, attached and fixed to an outer surface of the arc-shaped section;

a fifth section, attached and fixed to an outer surface of the second flat plate section, and also fixedly connected to the fourth section; and a sixth section, located on one side of the fifth section away from the fourth section, the sixth section being protruded out of the rotary ring along the axial direction of the rotary ring and being also fixedly connected to the fifth section.

11. The rotary frame according to claim 10, wherein the sixth section is provided with a second pin hole.

12. The rotary frame according to claim 1, wherein the supporting base is provided with a through hole, and a loop of connecting holes are formed in the circumferential direction of the through hole.

13. The rotary frame according to claim 1, wherein the rotary frame is symmetrical with respect to the center line.

14. A grader, comprising the rotary frame according to claim 1.

15. The grader according to claim 14, further comprising:

an angle position device, rotatably mounted at the first pin hole of the first connecting piece and the second pin hole of the second connecting piece;

a blade, slidingly mounted on the angle position device; and an oil cylinder, mounted between the rotary ring and the angle position device.

16. The grader according to claim 15, further comprising:

a driving part, in driving connection with the blade to drive the blade to slide relative to the angle position device; and a guide part, comprising a sliding groove and a guide rail, wherein the angle position device is provided with the sliding groove, the blade is fixedly connected to the guide rail, and the sliding groove cooperates with the guide rail.

* * * * *